US006325604B1

(12) United States Patent
Du

(10) Patent No.: US 6,325,604 B1
(45) Date of Patent: Dec. 4, 2001

(54) PLASTIC GEAR PUMP HOUSING

(76) Inventor: Benjamin R. Du, 22832 Skyview Ave., Laguna Hills, CA (US) 92677

( * ) Notice: Subject to any disclaimer, the term of this patent is extended or adjusted under 35 U.S.C. 154(b) by 0 days.

(21) Appl. No.: 09/538,059

(22) Filed: Mar. 29, 2000

(51) Int. Cl.[7] ..... F04C 15/00

(52) U.S. Cl. ..... 418/152; 418/206.9; 418/206.1; 418/182; 264/331.11

(58) Field of Search ..... 418/206.9, 152, 418/206.1, 182; 264/331.11

(56) References Cited

U.S. PATENT DOCUMENTS

| | | | | |
|---|---|---|---|---|
| 2,833,224 | * | 5/1958 | Meyer et al. | 418/206.9 |
| 2,966,860 | * | 1/1961 | Maynard | 418/152 |
| 3,128,710 | * | 4/1964 | Blomgren et al. | 418/152 |
| 3,139,834 | * | 7/1964 | Blomgren et al. | 418/152 |
| 3,390,638 | * | 7/1968 | Adams | 418/206.6 |
| 3,859,014 | * | 1/1975 | Dworak et al. | 418/152 |
| 4,273,503 | * | 6/1981 | Damron | 414/694 |
| 4,583,924 | * | 4/1986 | Zenglein et al. | 418/206.9 |
| 4,747,762 | * | 5/1988 | Fairbairn | 418/152 |
| 4,925,370 | * | 5/1990 | Tallarita | 417/15 |
| 6,004,119 | * | 12/1999 | Hamasaki et al. | 418/206.1 |

FOREIGN PATENT DOCUMENTS

| | | | | |
|---|---|---|---|---|
| 2141486-A1 | * | 12/1984 | (GB) | 418/152 |
| 60-062683-A1 | * | 4/1985 | (JM) | 418/152 |
| 04-041984-A1 | * | 2/1992 | (JP) | 418/152 |

* cited by examiner

*Primary Examiner*—Thomas Denion
*Assistant Examiner*—Theresa Trieu
(74) *Attorney, Agent, or Firm*—Stetina Brunda Garred & Brucker

(57) ABSTRACT

A gear pump comprising a plastic gear pump housing having an interior surface. Rotatably attached to the gear pump housing is a drive gear and an idler gear. The idler gear is cooperatively engaged to the drive gear such that rotation of the drive gear will rotate the idler gear. The gear pump housing is formed from plastic such that the interior surface thereof is sized to contact the drive gear and the idler gear. Accordingly, the contact between the idler gear and the drive gear with the interior of the plastic gear pump housing forms a seal therebetween which is used for the pumping of fluid by the gear pump.

10 Claims, 6 Drawing Sheets

PLASTIC GEAR PUMP HOUSING

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to gear pumps and more particularly to a gear pump housing manufactured from a plastic material which maintains exacting tolerances for proper pumping operation.

Gear pumps are used to transfer fluid from one location to another by pressurizing the fluid. Typically, the gear pump comprises two intermeshing rotatable gears. One of the gears is a drive gear coupled to a driver motor operable to rotate the drive gear to facilitate the transfer and pressurization of fluid. The second gear is an idler gear cooperatively engaged to the drive gear. Both the drive gear and the idler gear contain complementary teeth which mesh with each other in order to rotate the idler gear and transfer fluid.

Both the idler gear and the drive gear are disposed within a gear pump housing manufactured from a metallic material to exacting tolerances. The idler gear and the drive gear are disposed within the gear pump housing such that the outer diameters of each make contact and seal against the gear pump housing. Accordingly, the gear pump housing is partitioned into two chambers defined by the idler gear and the drive gear. Specifically, a bottom chamber of the gear pump housing is defined by the bottom halves of each of the idler gear and the drive gear. Correspondingly, the upper chamber of the gear pump housing is defined by the upper halves of the idler gear and the drive gear. The bottom half or lower chamber of the gear pump housing fluidly communicates with a fluid intake port, whereas the upper half or upper chamber of the gear pump housing fluidly communicates with a fluid outlet port. It will be recognized that by reversing the direction of rotation of the drive gear, the fluid intake port disposed in the lower chamber of the gear pump housing will then become the fluid outlet port and the fluid outlet port disposed on the upper chamber of the gear pump housing will then become the fluid intake port.

During operation of the gear pump, both the idler and drive gears rotate within the gear pump housing. In this respect, fluid may be drawn into the lower chamber of the gear pump housing through the intake port. The rotation of the idler and drive gears within the gear pump housing forces the fluid into the upper chamber of the gear pump housing and hence into the outlet port. The fluid exits the upper chamber of the gear pump housing through the outlet port formed therein. It will be recognized that in order to transfer the fluid from the lower chamber to the upper chamber, both the idler gear and the drive gear must maintain contact with the interior surfaces of the gear pump housing to form a seal therebetween. Additionally, both the idler gear and the drive gear must tightly intermesh in order to form a seal which segregates the lower chamber from the upper chamber.

As previously mentioned, prior art gear pump housings have been fabricated from metallic materials in order to maintain an exacting tolerance between the idler gear and between the drive gear. In this regard, the metallic gear pump housing is manufactured to a size which maintains a seal against the drive gear and idler gear as required for proper operation. However, metallic gear pump housings are expensive to manufacture due to the time and effort required to form the gear pump housing to the correct dimensions. Additionally, metallic gear pump housings are heavy and difficult to work with. Therefore, there is presently a need for a gear pump housing which is inexpensive to fabricate and easy to assemble into a complete gear pump.

The present invention addresses the above-mentioned deficiencies in prior art gear pump housings by providing a gear pump housing which is formed from a plastic material. In this respect, the gear pump housing of the present invention is easy to manufacture and handle. Additionally, the present invention provides a method of forming a plastic gear pump housing which maintains the tolerances needed for proper operation. Specifically, the present invention provides a method wherein the plastic gear pump housing can be manufactured to the tolerances needed for operation with the idler gear and drive gear.

BRIEF SUMMARY OF THE INVENTION

In accordance with the present invention there is provided a gear pump comprising a plastic gear pump housing having an interior surface. The gear pump further includes a drive gear and an idler gear each rotatably attached to the gear pump housing and cooperatively engaged to one another. In the preferred embodiment, the interior surface of the plastic gear pump housing is sized to contact the drive gear and the idler gear in a manner to provide a seal therebetween. The gear pump may further include an outer cover engageable to the plastic gear pump housing in a manner wherein the plastic gear pump housing and the cover collectively define an interior chamber of the gear pump. The interior chamber is sized and configured to receive the drive gear and the idler gear of the gear pump.

In the preferred embodiment of the present invention, the drive gear is attached to a drive shaft rotatably connected to the plastic gear pump housing and the idler gear is attached to an idler shaft rotatably connected to the plastic gear pump housing. In this respect, the plastic gear pump housing defines a first axis spaced form the interior surface by a first distance substantially equal to the radius of the drive gear. Similarly, the plastic gear pump housing defines a second axis spaced from the interior surface by a second distance substantially equal to the radius of the idler gear. In the preferred embodiment, the drive shaft extends along the first axis and the idler shaft extends along the second axis.

The drive shaft is coupled to a motor for rotation of the drive shaft and corresponding drive gear. Furthermore, in order to rotate the drive shaft, the motor may include a coupler drive attached to a motor shaft and the drive shaft may include a coupler. In this respect the coupler drive is engageable to the coupler in order to transfer rotation to the drive shaft and drive gear. Furthermore, the coupler or drive coupler may be fabricated from a rubber material in order to prevent wobble and vibration between the drive shaft and the motor.

In accordance with the present invention there is provided a method of forming a plastic gear pump housing for a gear pump. The method comprises forming a plug and then a mold for the plastic gear pump housing. Next, the plug is inserted and secured to the mold in a prescribed position. The plastic gear pump housing is molded by injecting a plastic material into the mold. Finally, the molded plastic gear pump housing is removed from the mold and the plug is removed from the interior of the gear pump housing to thereby form an interior surface of the gear pump housing. The plug is formed with a first plug positioning hole spaced from a first arcuate portion by a first distance substantially equal to the radius of the drive gear. Additionally, the plug is formed with a second plug positioning hole space from a second arcuate portion by a second distance substantially equal to the radius of the idler gear. Typically, the plug is secured within the mold by a drive shaft and idler shaft of the gear pump. Furthermore, it will be recognized that the plug is secured in a position whereat the plug forms an interior surface of the gear pump housing that seals against an idler gear and drive gear of the gear pump.

BRIEF DESCRIPTION OF THE DRAWINGS

These as well as other features of the present invention will become more apparent upon reference to the drawings wherein.

DETAILED DESCRIPTION OF THE INVENTION

Figure 1:
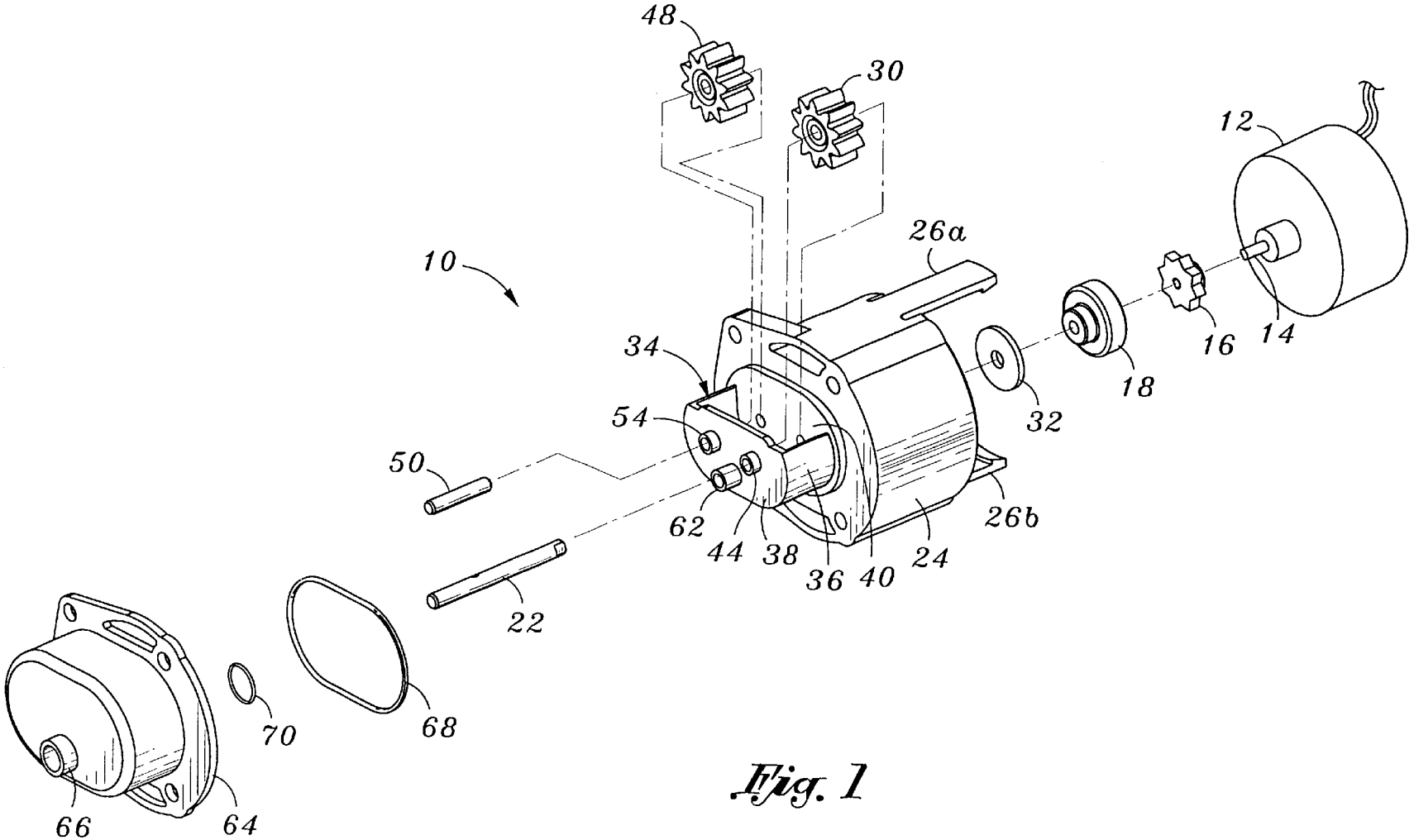
FIG. 1 is an exploded perspective view of a gear pump constructed in accordance with the present invention.

Referring now to the drawings wherein the showings are for purposes of illustrating a preferred embodiment of the present invention only and not for purposes of limiting the same, FIG. 1 perspectively illustrates a gear pump 10 constructed in accordance with the present invention and used for pumping a fluid (i.e., liquid). The gear pump 10 includes a motor 12 having a motor shaft 14 extending axially therefrom. The motor 12 may be an electric or hydraulic motor capable of rotating the motor shaft 14 at a prescribed rate. Alternatively, the motor 12 may be a stepper motor which can rotate the motor shaft 14 in prescribed increments. In either instance, the motor 12 is capable of supplying torque and rotation to the motor shaft 14.

Figure 2:
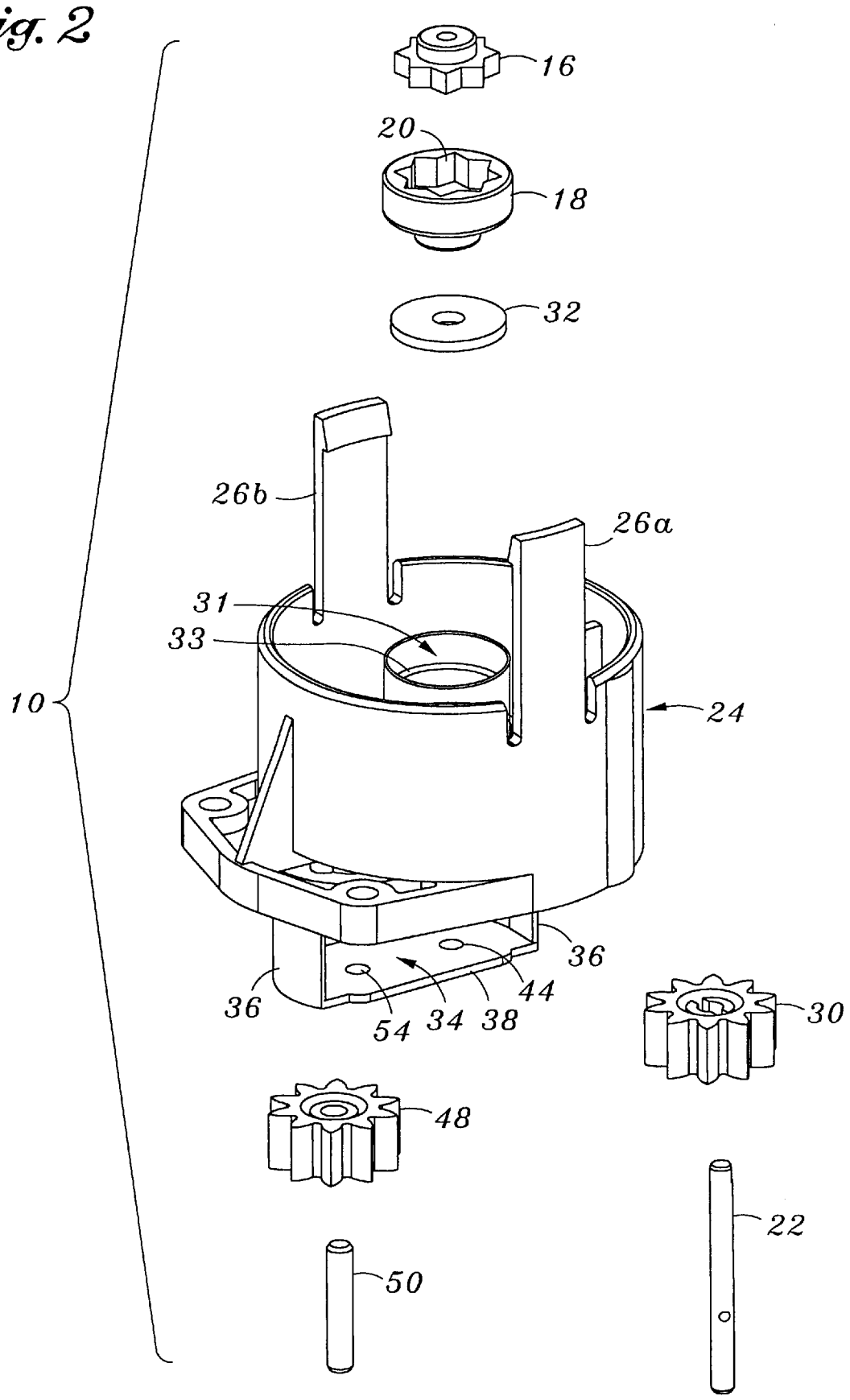
FIG. 2 is an exploded perspective view of a gear pump housing showing drive and idler gears constructed in accordance with the present invention.
Figure 3:
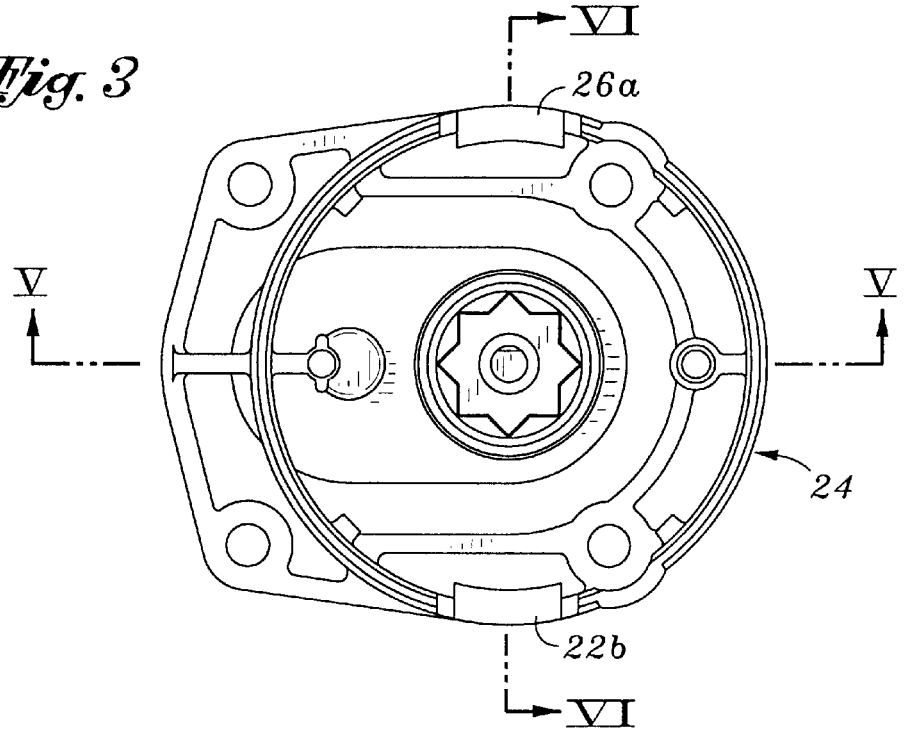
FIG. 3 is a top view of the gear pump housing shown in FIG. 2.

Referring to FIGS. 1 and 2, mounted to the distal end of the motor shaft 14 is a coupler drive 16. The coupler drive 16 is generally star shaped such that a plurality of teeth extend radially therefrom. Typically, the coupler drive 16 is fabricated from a plastic material and formed through conventional plastic molding techniques. In order to transfer torque from the motor 12, the gear pump 10 includes a coupler drive receptacle 18. The coupler drive receptacle 18 includes a coupler drive recess 20 shaped complementary to the coupler drive 16. The star shaped coupler drive 16 is insertable into the coupler drive recess 20 such that rotation of the motor shaft 14 and the coupler drive 16 will rotate the coupler drive receptacle 18. As will be recognized, the star shaped coupler drive 16 and complementary star shaped coupler drive recess 20 provide multiple load bearing surfaces for the transfer of torque from the motor shaft 14 to the coupler drive receptacle 18. It is not necessary for the coupler drive 16 and the coupler drive recess 20 to be star shaped, as any other shape will perform the necessary function of transferring torque from the motor shaft 14 to the coupler drive receptacle 18. In the preferred embodiment, the coupler drive receptacle 18 is formed from a rubber type material in order to provide dampening between the motor 12 and the gear pump 10. In this respect, the rubber coupler drive receptacle 18 reduces vibration and wobble from the motor 12.

Figure 5:
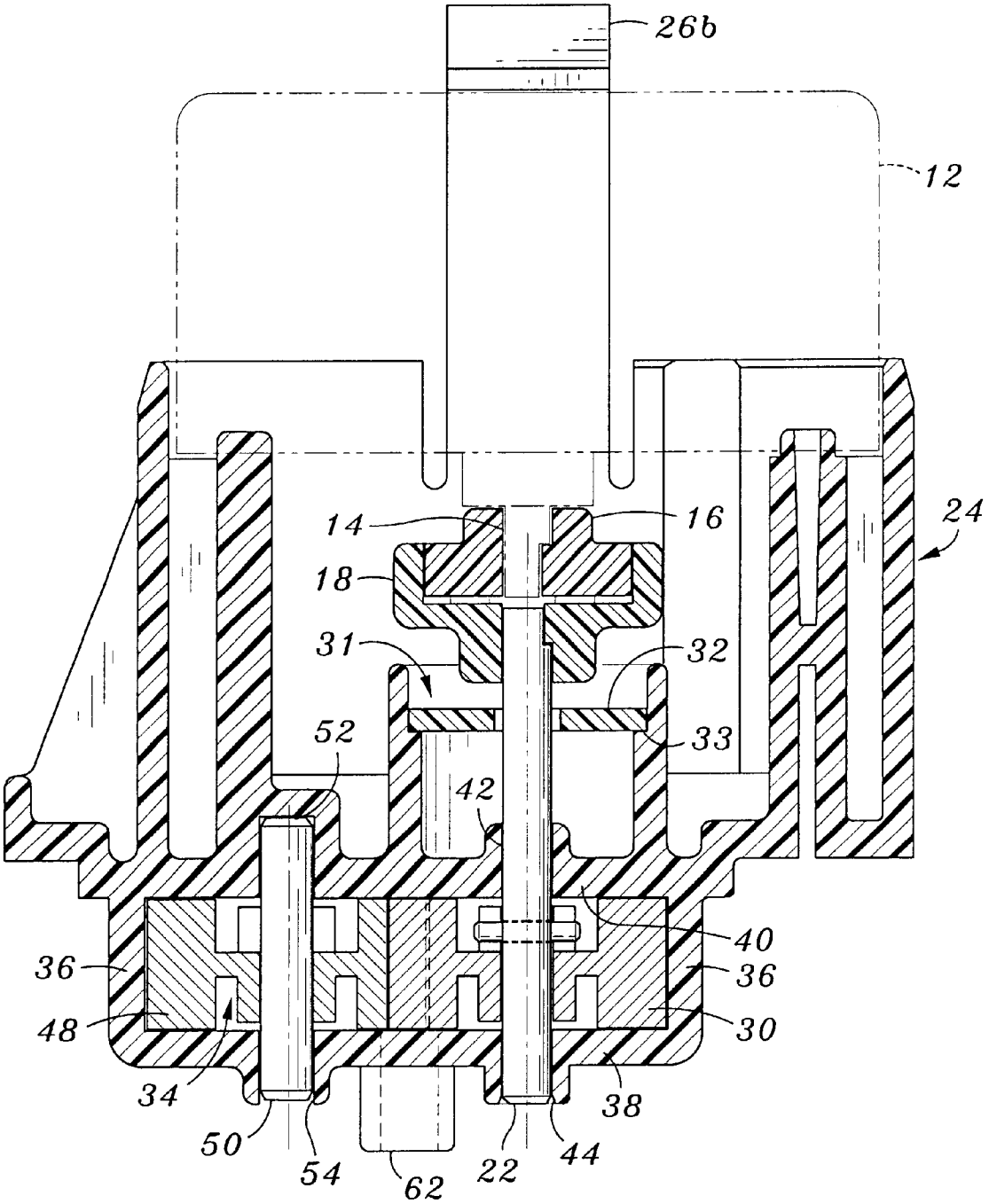
FIG. 5 is a cross sectional view of the gear pump housing taken along line V—V of FIG. 3.
Figure 6:
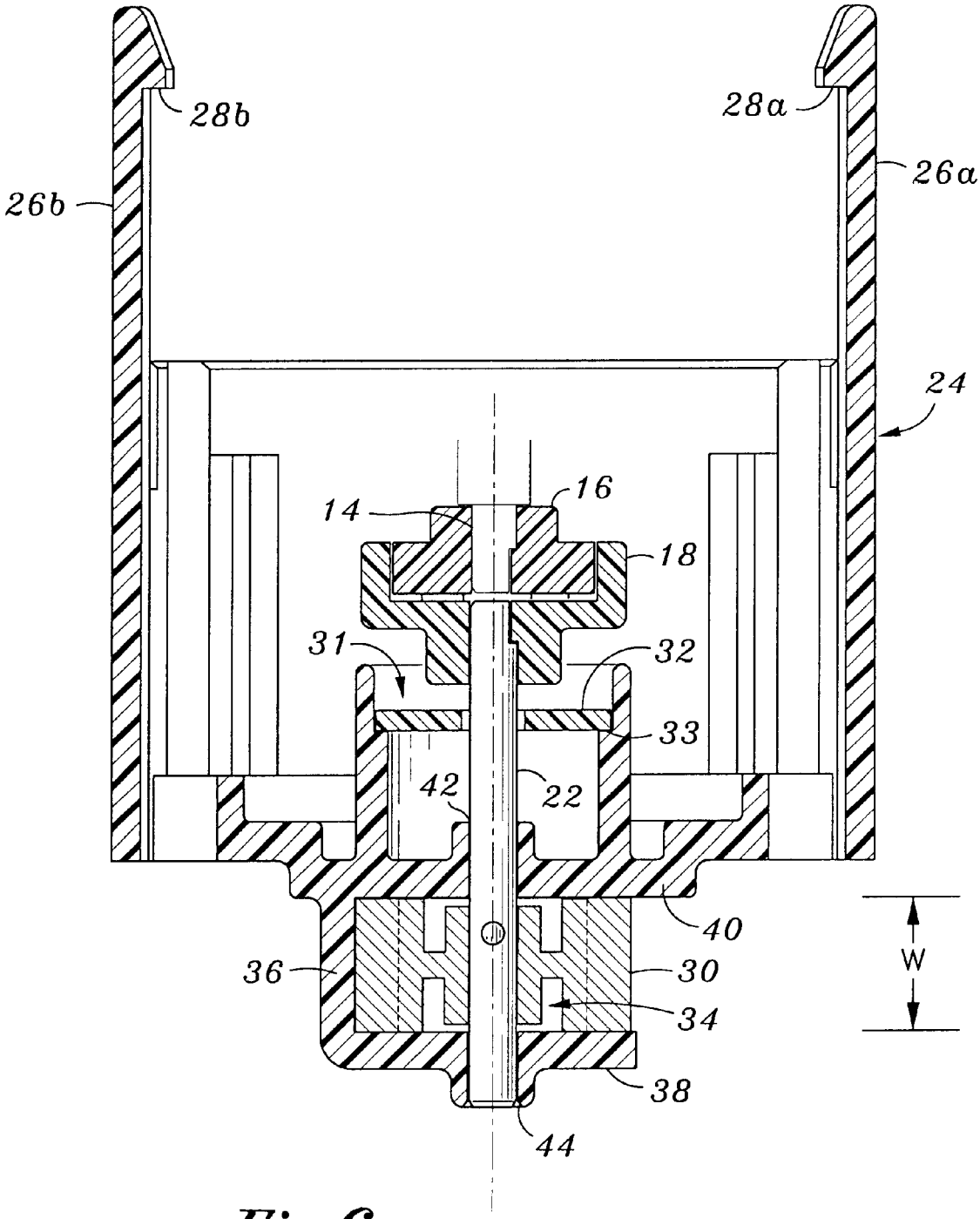
FIG. 6 is a cross sectional view of the gear pump housing taken along line VI—VI of FIG. 3.

Referring to FIGS. 5 and 6, the coupler drive receptacle 18 is attached to one end of a drive shaft 22 supported within a plastic gear pump housing 24 of the gear pump 10. The drive shaft 22 is supported within the gear pump housing 24 and is freely rotatable. The gear pump housing 24 supports the operational components of the gear pump 10 and is attachable to the motor 12 through the use of flanges 26*a*, 26*b*. Each of the flanges 26*a*, 26*b* is configured to snap over the rear of the motor 12. In this respect, each of the flanges 26*a*, 26*b* flexes outwardly from a central axis of the gear pump housing 24 during attachment of the gear pump housing 24 to the motor 12. As seen in FIG. 6, each of the flanges 26*a*, 26*b* includes a respective ledge 28*a*, 28*b* for engaging the rear of the motor 12. As previously mentioned, the coupler drive receptacle 18 is formed from a rubber material and as such may compress when the coupler drive 16 and motor 12 are attached to the gear pump housing 24. The flanges 26*a*, 26*b* compress and secure the motor 12 firmly against the gear pump housing 24 such that the coupler drive receptacle 18 will be compressed by the coupler drive 16 attached to the motor shaft 14 of the motor 12.

Referring to FIGS. 5 and 6, mounted to the drive shaft 22 is a drive gear 30 disposed within the gear pump housing 24. The drive gear 30 is fixedly attached to the drive shaft 22 such that as the drive shaft 22 rotates within the gear pump housing 24, the drive gear 30 will rotate. Therefore, as the motor shaft 14 of the motor 12 rotates, the drive shaft 22 will rotate the drive gear 30. As previously mentioned, the gear pump 10 is used for the transfer of fluid, and as such, must contain fluid. Therefore, the drive shaft 22 includes a shaft seal 32 (i.e., washer) attached thereto. Referring to FIG. 6, the shaft seal 32 is disposed within an interior chamber 31 of the gear pump housing 24. In this respect, the shaft seal 32 contacts an inner lip 33 of the chamber 31. The shaft seal 32 provides a fluid tight barrier between the motor 12 and the gear pump housing 24 so as to prevent exposure of pumped fluid to the motor 12.

The drive gear 30 is disposed within a pump chamber 34 of the gear pump housing 24. The pump chamber 34 is integrally formed within the gear pump housing 24 through the use of a plastic molding technique that will be explained below. The pump chamber 34 comprises a generally C-shaped outer wall 36 disposed between an end wall 38 and a back wall 40 of the gear pump housing 24. The drive shaft 22 is advanced through a back wall aperture 42 formed in the back wall 40 and an end wall aperture 44 formed in the end wall 38. Both the back wall aperture 42 and the end wall aperture 44 are sized slightly larger than the outer diameter of the drive shaft 22 such that the drive shaft 22 and drive gear 30 attached thereto are freely rotatable.

Figure 7:
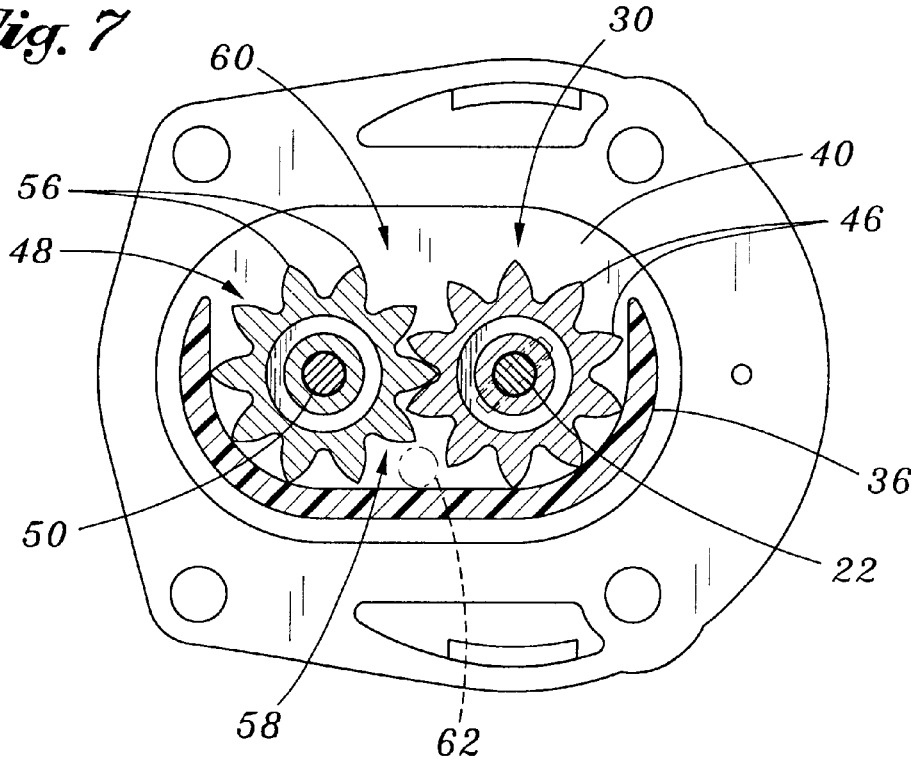
FIG. 7 is a cross sectional view of the gear pump housing taken along line VII—VII of FIG. 4.

As seen in FIG. 7, the pump chamber 34 and the drive gear 30 are sized relative to each other such that the drive gear 30 contacts an inner surface of the C-shaped outer wall 36. In this respect, the drive gear 30 is formed with a series of teeth 46 extending radially outwardly therefrom. The teeth 46 completely surround the circumference of the drive gear 30. The width "W" of the pump chamber 34 is substantially equal to the thickness of the drive gear 30, as seen in FIG. 6. Accordingly, when the drive gear 30 is inserted into the pump chamber 34 and secured with the drive shaft 22, an inner surface of the end wall 38 will be in abutting contact with a planar front surface of the drive gear 30. Correspondingly, a planar rear surface of the drive gear 30 will be in abutting contact with the back wall 40 of the pump chamber 34. Additionally, the pump chamber 34 is formed such that the outermost edges of the teeth 46 of the drive gear 30 are in sliding contact with the inner surface of the outer wall 36. In this respect, the radius of curvature of the outer wall 36 is substantially equal to the radius of the drive gear 30 at the outermost edge of the teeth 46 thereof. As will be recognized, the diameter of the drive gear 30 will be the diameter at the outermost point or teeth 46 of the drive gear 30 and the radius of the drive gear 30 will be between the center of the drive gear 30 and the outermost point of the teeth 46.

In order to properly pump fluid, the gear pump 10 further includes an idler gear 48 formed identical to the drive gear 30. As seen in FIGS. 5 and 7, the idler gear 48 is fixedly attached to a idler shaft 50. The idler shaft 50 is secured within the gear pump housing 24 through the use of an idler shaft back wall aperture 42 formed within the back wall 40 and an idler shaft end wall aperture 54 formed within the end wall 38. In this respect, the idler gear 48 and idler shaft 50 are freely rotatable within the pump chamber 34 of the gear pump housing 24. Similar to the drive gear 30, the idler gear 48 comprises a series of idler gear teeth 56 disposed about the circumference thereof. The idler gear teeth 56 and corresponding notches formed thereby are complementary to the drive gear teeth 46 and corresponding notches. The idler gear teeth 56 mesh with the notches of the drive gear 30 and the drive gear teeth 46 mesh with the notches of the idler gear 48. The rotation of the drive gear 30 in a counterclockwise direction will rotate the idler gear 48 in a clockwise direction. As seen in FIG. 7, the idler gear 48 slidably contacts the inner surface of the outer wall 36 of the pump chamber 34 in the same manner as the drive gear 30. Additionally, since the idler gear 48 is formed identical to the drive gear 30, the front and rear planar surfaces of the idler gear 48 will contact the end wall 38 and back wall 40 thereof, respectively.

Referring to FIG. 7, the idler gear 48 and the drive gear 30 partition the pump chamber 34 into a lower chamber 58 and a upper chamber 60. The lower chamber 58 is collectively defined by the lower half of the pump chamber 34 and the lower portions of the drive gear 30 and idler gear 48, as seen in FIG. 7. In this respect, the drive gear teeth 46 and idler gear teeth 56 contact the outer wall 36 and form a seal therebetween in the lower chamber 58 of the pump chamber 34. Disposed within the end wall 38 and positioned in fluid communication with the lower chamber 58 of the pump chamber 34 is a fluid port 62. The fluid port 62 is located in a position whereat fluid may enter the lower chamber 58 of the pump chamber 34. During counterclockwise of the drive gear 30, fluid entering the lower chamber 58 through fluid port 62 will be transferred to the upper chamber 60 of the pump chamber 34 by the drive gear 30 and idler gear 48. In this respect, it is essential for the drive gear 30 and idler gear 48 to seal with the outer wall 36, as well as the back wall 40 and end wall 38. If a seal does not occur therebetween then fluid will not be communicated to the upper chamber 60 of the pump chamber 34.

Figure 4:
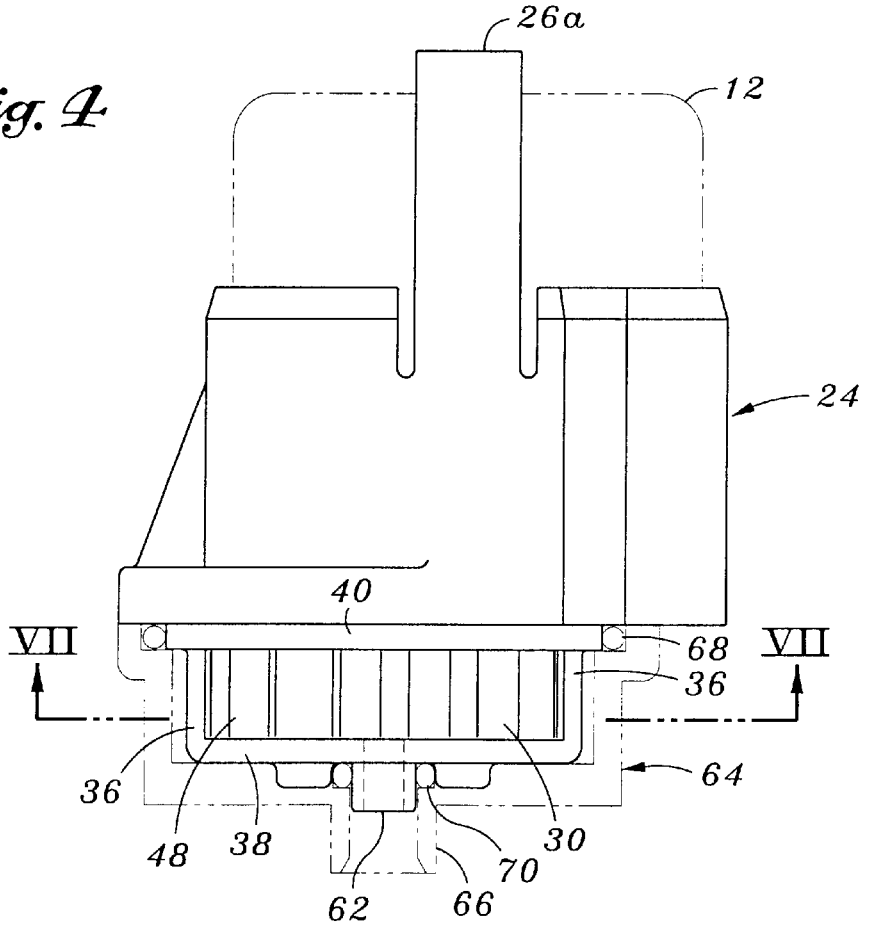
FIG. 4 is a side elevational view of the gear pump housing shown in FIG. 2.

The gear pump 10 of the present invention further includes a pump chamber cover 64. The pump chamber cover 64 is configured to enclose the pump chamber 34 and as such has an interior portion sized slightly larger than the pump chamber. Accordingly, the upper chamber 60 is defined by the upper portions of the drive gear 30 and idler gear 48, as well as the interior surface of the outer wall 36 and inner surface of the pump chamber cover 64. The pump chamber cover 64 includes a transfer port 66 which is co-axially aligned and fluidly communicates with the fluid port 62 of the pump chamber 34 when the pump chamber cover 64 is attached to the gear pump housing 24. As seen in FIGS. 1 and 4, the pump chamber cover 64 abuts the gear pump housing 24 when attached thereto. Accordingly, the gear pump 10 includes an oval O-ring 68 which creates a fluid-tight seal between the pump chamber cover 64 to the gear pump housing 24. Additionally, a circular O-ring 70 seals the fluid port 62 to the transfer port 66 such that fluid does not leak therebetween. In this respect, the pump chamber cover 64, when attached to the gear pump housing 24, encloses the upper chamber 60 of the pump chamber 34. Fluid is transferred from the lower chamber 58 of the pump chamber 34 up into the upper chamber 60 which is enclosed by the pump chamber cover 64.

In the preferred embodiment of the present invention, the gear pump 10 may be used as a controller for a valve (not shown). In this respect, counterclockwise rotation of the drive gear 30 will transfer fluid from the fluid port 62 and lower chamber 58 of the pump chamber 34 into the upper chamber 60. The counterclockwise rotation of the drive gear 30 creates a low pressure differential which draws fluid into the transfer port 66 and the fluid port 62. The creation of low pressure can be used to control the opening or closing of the valve. In contrast, the clockwise rotation of the drive gear 30 transfers fluid from the upper chamber 60 of the pump chamber 34 into the lower chamber 58 thereof. The clockwise rotation of the drive gear 30 increases pressure within the lower chamber 58 such that fluid will be directed out from the fluid port 62 and transfer port 66. The increase in pressure can be used to control the valve as desired. In this respect, the gear pump 10 as shown by the drawings includes a single fluid port 62. As previously mentioned the motor 12 may be a stepper motor whereby the direction of the motor may be controlled easily. By reversing the direction of the motor 12, it is possible to create either high or low pressure at the fluid port 62 and hence the transfer port 66 for controlling the valve.

It will be recognized that the gear pump 10 may be also used as a pump for transferring a large volume of fluid. In this respect, the fluid port 62 and transfer port 66 may be an input port for the gear pump 10. Additionally, the gear pump 10 could include an outlet port in fluid communication with the upper chamber 60 of the pump chamber 34. Fluid would be transferred from the input port to the outlet port by the drive gear 30 and idler gear 48. It will be recognized that by reversing the direction of the drive gear 30 that fluid will then enter the outlet port and exit the pump chamber 34 at the inlet port.

As mentioned above, the gear pump housing 24, as well as the pump chamber 34, are fabricated from a plastic material. As such, the idler gear 48 and the drive gear 30 must seal against the pump chamber 34 and segregate the pump chamber 34 into the upper chamber 60 and lower chamber 58 for proper pumping operation. Accordingly, it is necessary to manufacture the pump chamber 34 within a prescribed tolerance in order to ensure that the idler gear 48 and the drive gear 30 seal with the interior of the pump chamber 34, and more particularly against the interior of the outer wall 36.

Figure 8:
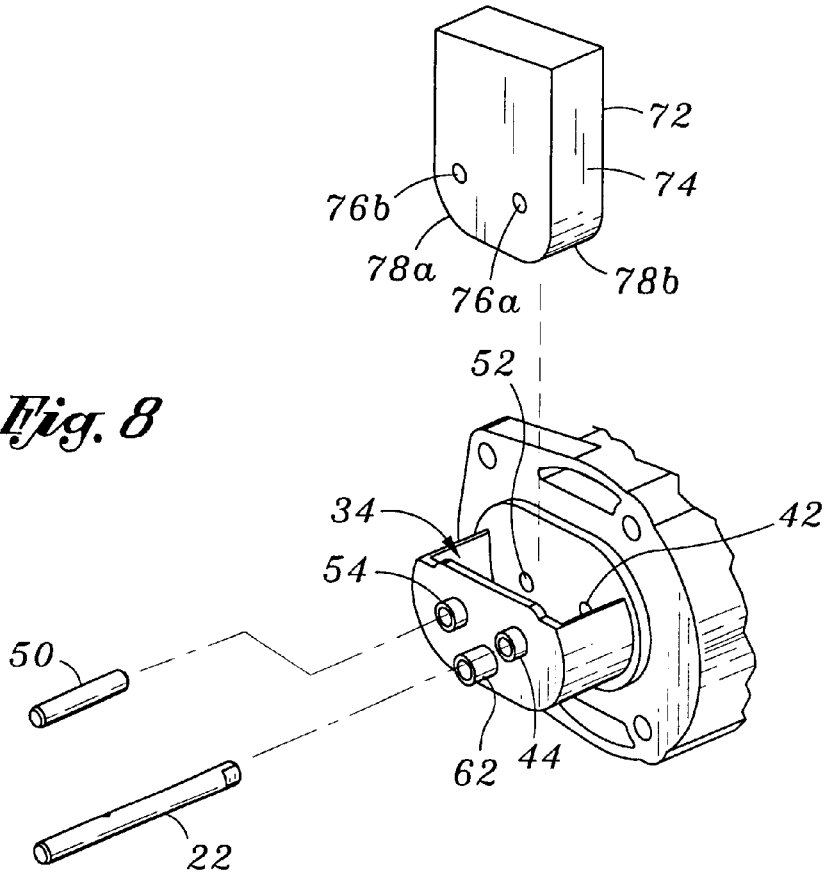
FIG. 8 is an exploded perspective view showing the manner in which the gear pump housing shown in FIG. 2 is fabricated.

The pump chamber 34 is formed through the use of a plastic molding technique. Specifically, a mold (not shown) is fabricated which is complementary to the shape of the gear pump housing 24. As previously mentioned, the pump chamber 34 is integrally fabricated with the gear pump housing 24. In order to form the pump chamber 34 into the proper shape and maintain the tolerances needed for proper operation of the gear pump 10, a plug 72 is used during the molding process, as shown in FIG. 8. The plug 72 is formed complementary to the interior shape of the pump chamber 34 and has an outer surface 74 with a first and second arcuate portion 78*a,* 78*b.* Furthermore, the plug 72 includes plug positioning holes 76*a,* 76*b* extending through the interior thereof. The plug positioning holes 76*a,* 76*b* are positioned from the first and second arcuate portions 78*a,* 78*b* in a location substantially equal to the radius of the drive gear 30 and the idler gear 48. Specifically, the distance from the axis of the plug positioning hole 76*a* to the second arcuate portion 78*b* is substantially equal to the radius of the drive gear 30. Similarly, the distance from the axis of the plug positioning hole 76*b* to the first arcuate portion 78*a* is substantially equal to the radius of the idler gear 48. In the preferred embodiment, the distance from the plug positioning hole 76*b* and first arcuate portion 78*a* is equal to the distance from the plug positioning hole 76*a* and the second arcuate portion 78*b* because the radius of the drive gear 22 and the radius of the idler gear 48 are substantially equal. It will be recognized that the drive gear 22 and the idler gear 48 are substantially identical thereby resulting in the radius of each to be substantially equal.

The plug 72 is placed within the mold in the location whereat the pump chamber 34 will be formed as a result of the flow of plastic material about the plug 72. As seen in FIG. 8, the idler shaft 50 is advanced through plug positioning hole 76*b* and the idler shaft 50 is advanced through plug positioning hole 76*a* in order to maintain the plug 72 in proper position during molding of the pump chamber 34 and gear pump housing 24. In this respect, the plug 72 will size the pump chamber 34 such that the idler gear 48 and the drive gear 30 will seal with the interior of the pump chamber 34 after assembly thereof. It will be recognized by those of ordinary skill in the art that the plug 72 may be maintained in position by other types of methods, not just the drive shaft 22 and the idler shaft 50. Once the pump chamber 34 and the plastic gear pump housing 24 have been formed, the plug 72 is removed therefrom. Through the use of this method, it is possible to manufacture the plastic gear pump housing 24 which maintains tolerances needed for the use and operation of the gear pump 10.

Additional modifications and improvements of the present invention may also be apparent to those of ordinary skill in the art. Thus, the particular combination of parts described and illustrated herein is intended to represent only a certain embodiment of then present invention, and is not intended to serve as a limitation of alternative devices within the spirit and scope of the invention.

What is claimed is:

1. A gear pump comprising:

a plastic gear pump housing having an interior surface and at least one exteriorly extending, releasably engageable connector for connecting the pump housing with a motor powering the pump;

a drive gear rotatably attachable to the plastic gear pump housing; and an idler gear rotatably attachable to the plastic gear pump housing and cooperatively engageable to the drive gear;

wherein the interior surface of the plastic gear pump housing is sized to contact the drive gear and the idler gear in a manner providing a seal therebetween.

2. The gear pump of claim 1 further comprising an outer cover engageable to the plastic gear pump housing in a manner wherein the plastic gear pump housing and the cover collectively define an interior chamber sized and configured to receive the drive gear and the idler gear.

3. The gear pump of claim 1 wherein:

the drive gear is attached to a drive shaft rotatably connected to the plastic gear pump housing; and the idler gear is attached to an idler shaft rotatably connected to the plastic gear pump housing.

4. The gear pump of claim 3 wherein the plastic gear pump housing defines:

a first axis spaced from the interior surface by a first distance substantially equal to the radius of the drive gear; and a second axis spaced from the interior surface by a second distance substantially equal to the radius of the idler gear;

the drive shaft extending along the first axis and the idler shaft extending along the second axis.

5. The gear pump of claim 3 further comprising a motor attached to the drive shaft and operative to rotate the drive gear.

6. The gear pump of claim 5 further comprising:

a coupler attached to the drive shaft; and a coupler drive attached to the motor;

wherein the coupler drive is engageable to the coupler and prevents wobble between the drive shaft and the motor.

7. The gear pump of claim 6 wherein the coupler drive is fabricated from a rubber material in order to prevent wobble between the drive shaft and the motor.

8. The gear pump of claim 1 wherein the plastic gear pump housing further comprises a fluid port in fluid communication with the interior chamber for the flow of fluid into and out of the gear pump.

9. The gear pump of claim 1 wherein the at least one connector of the gear pump housing is an inwardly biased flange integral with the pump housing and with a distal ledge for engaging the motor.

10. The gear pump of claim 9 wherein the gear pump housing has two inwardly biased flange disposed substantially opposite each other.

* * * * *